United States Patent [19]

Boyd

[11] Patent Number: 4,773,589

[45] Date of Patent: Sep. 27, 1988

[54] HEAT CONTROL SYSTEMS

[76] Inventor: Charles M. Boyd, P.O. Box 634, Ft. Collins, Colo. 80522

[21] Appl. No.: 140,421

[22] Filed: Apr. 15, 1980

[51] Int. Cl.[4] ..... F24B 1/18

[52] U.S. Cl. ..... 237/51; 237/55; 126/121

[58] Field of Search ..... 237/51, 55, 50; 165/DIG. 2; 126/121, 122, 134, 164

[56] References Cited

U.S. PATENT DOCUMENTS

| | | | |
|---|---|---|---|
| 2,166,623 | 7/1939 | Chandler | 236/93 R |
| 2,361,641 | 10/1944 | Mueller | 237/55 |
| 2,601,314 | 6/1952 | Miles | 126/73 |
| 4,026,263 | 3/1977 | Boyd | 126/121 |
| 4,103,826 | 8/1978 | Wass | 237/55 |
| 4,138,062 | 2/1979 | Graden | 237/55 |
| 4,161,168 | 7/1979 | Gagle | 126/164 |
| 4,189,295 | 2/1980 | Ramon | 431/20 |
| 4,197,829 | 4/1980 | Pierce | 126/164 |
| 4,224,922 | 9/1980 | Moncrieft-Yeates | 126/121 |
| 4,257,392 | 3/1981 | Betenbaugh | 126/164 |
| 4,257,557 | 3/1981 | Thomasma et al. | 237/19 |
| 4,258,879 | 3/1981 | Nischwitz | 126/164 |
| 4,282,855 | 8/1981 | Perry | 126/121 |
| 4,294,223 | 10/1981 | Montague | 165/DIG. 2 |
| 4,308,990 | 1/1982 | Borovina et al. | 237/55 |
| 4,320,740 | 3/1982 | Lassy et al. | 126/121 |

FOREIGN PATENT DOCUMENTS

| | | | |
|---|---|---|---|
| 410415 | 5/1910 | France | 126/312 |
| 6961 | of 1905 | United Kingdom | 110/180 |

*Primary Examiner*—Henry A. Bennet

*Attorney, Agent, or Firm*—Hugh H. Drake

[57] ABSTRACT

Improvements in fireplace systems include several features some of which are separably usable in other heating apparatus. The features include a barometric damper adaptor, a grate structure, a manner of mounting hollow grate tubes in a fireplace assembly, an improved combustion chamber assembly, a combined damper and ducting system, a revised plenum system for a fireplace or the like and a tempering system cooperative with such a unit.

20 Claims, 9 Drawing Sheets

HEAT CONTROL SYSTEMS

The present invention pertains to heat control systems. More particularly, it relates to the improvements in prior such systems and to adaptations therefrom.

U.S. Pat. No. 4,026,263 describes and claims a fireplace system, with modifications and alternatives, that well serves to enable a user to obtain beneficial results over those afforded by predecessor fireplaces. While the systems described in that patent have been and continue to be successfully incorporated into use, it has become apparent that still further improvements may be desirable in some circumstances.

Moreover, continued research into the area of alternative heat sources for the typical residence or business has revealed the need for increased efficiency in performance of all kinds of different sources of heat. For certain, conservation of energy has become the name of the game.

It is, accordingly, one general object of the present invention to provide new and improved apparatus usable in connection with the practice of the teachings of the aforesaid patent.

Another general object of the present invention is to provide new and improved apparatus usable not only with that specific kind of equipment but also readily adaptable to a wide variety of other such apparatus.

A further object of the present invention is to provide heating system improvements which enhance both safety and efficiency of fuel consumption.

It is a related object of the present invention to provide new and improved apparatus of the foregoing character that is capable of being produced and sold in an economical manner.

In accordance with one feature of the present invention, a weighted damper is disposed in a conduit which opens laterally through the wall of an outer tube coupled into a stack at its outlet end and encircling an inner tube which connects with a combustion chamber. One or more aspects of the structure include those of the inner tube extending upwardly above the conduit, means defining a wall substantially closing the space between the inner and outer tubes at a location between the conduit and the combustion chamber, the inner tube preferably but not necessarily having a width less than the width of the stack, and sensing means responsive to temperature cooperative with locking means that hold the damper in a closed position with control enabled by the sensing means for operating the locking means in correspondence with activity within the combustion chamber.

Another aspect of the invention pertains to the inclusion of a door assembly spaced forwardly from the combustion chamber together with a closure assembly spaced between the door and the combustion chamber. The closure assembly further features one or more of a gate openable into the chamber and a damper selectively openable and disposed to permit the passage of air through the door assembly over and upwardly away from the primary combustion area in the chamber.

A further aspect of the present invention is directed to the use of a tube-type grate within which a plurality of assembled bars are seated, with those bars being conformed to seat above a manifold associated with the tubes and also having a shield that closes spaces between the forward end portions of the bars. Also involved is a multiply-secured clamping assembly for such tubes.

In its system aspect, the invention is particularly related to an arrangement wherein outside air is supplied for use in the combustion chamber and which includes means for circulating air in heat-exchange relationship with the combustion chamber but exclusive of the combustion air. The circulating means includes a plenum chamber together with an intake of air from outside the space being heated. A damper, disposed between the intake and the plenum chamber, is normally closed to prevent a back flow of warmed air to the outside but automatically admits the outside air into the plenum chamber upon demand.

Another aspect related to the same type of heating system involves the use of a duct that leads from the plenum chamber and outlets into the space to be heated. A normally-closed damper is disposed between the plenum chamber and the duct. That damper opens automatically in response to operation of a fan in the circulation system. Also with regard to the same basic approach in a heating system, still another aspect involves the inclusion of a duct that leads from the space being heated into the circulation system. A fan moves air in the circulation system, and a normally-open damper is located between the duct and the circulation system, this damper automatically closing in response to operation of the fan. A feature also desirably included with the foregoing, but useful separately in itself, embodies a duct that leads from a portion of such a plenum chamber, disposed above a discharge opening into the space being heated, to an entrance located in the vicinity of the bottom of the combustion chamber and opening into such space.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like numerals identify like elements, and in which:

Figure 1:
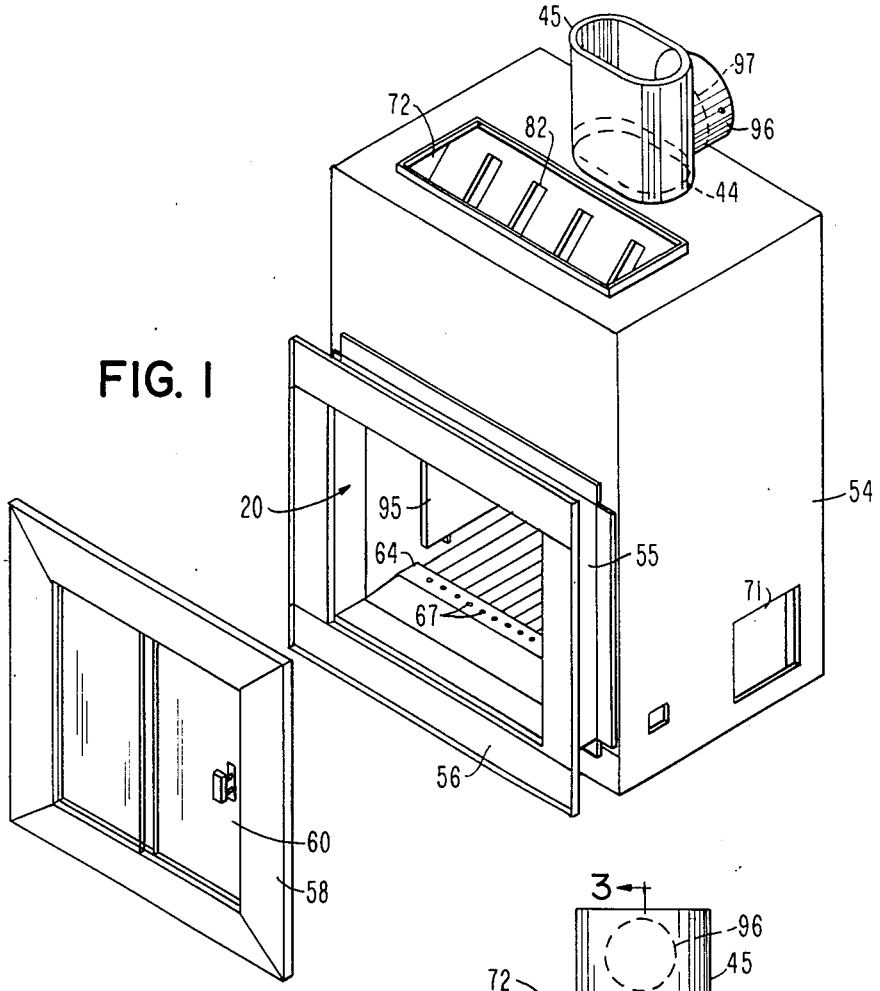
FIG. 1 is an exploded perspective view of a fireplace system.
Figure 2:
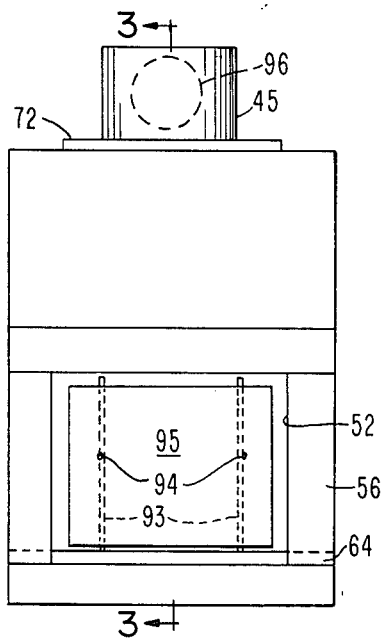
FIG. 2 is a front elevational view of a portion of the system of FIG. 1.
Figure 3:
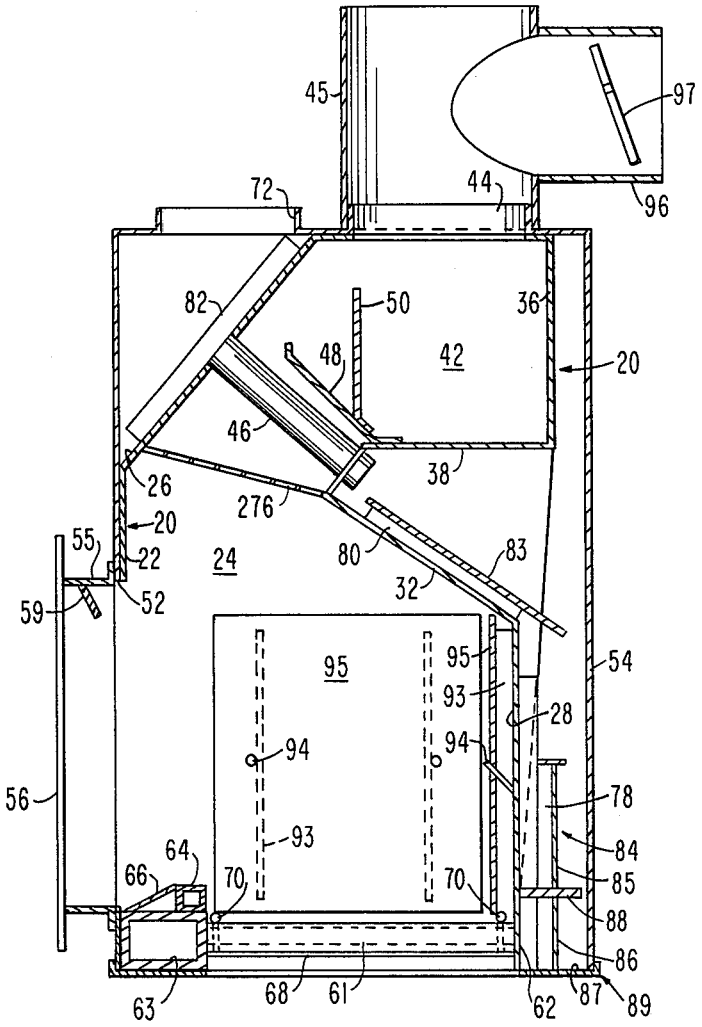
FIG. 3 is a cross-sectional view taken along the line 3—3 in FIG. 2.
Figure 4:
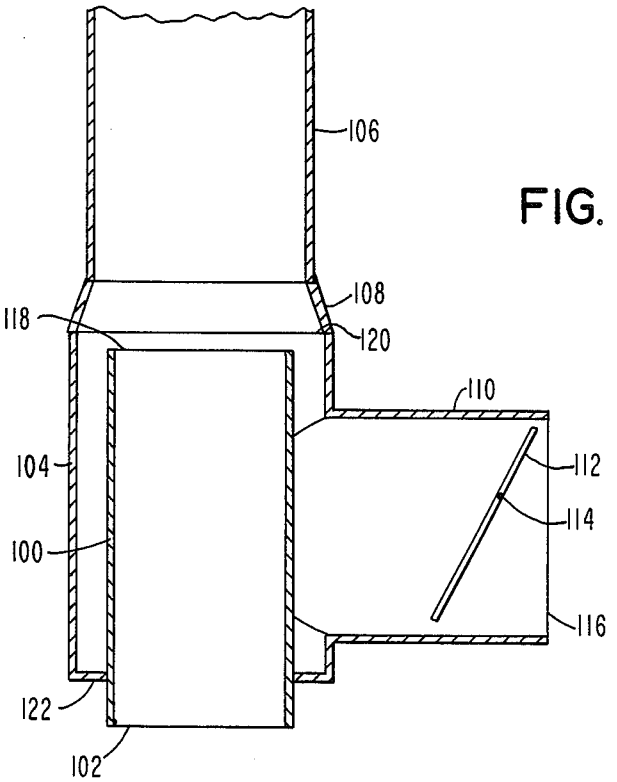
FIG. 4 is a fragmentary cross-sectional view of a component desirably used in the system of FIG. 1.
Figure 5:
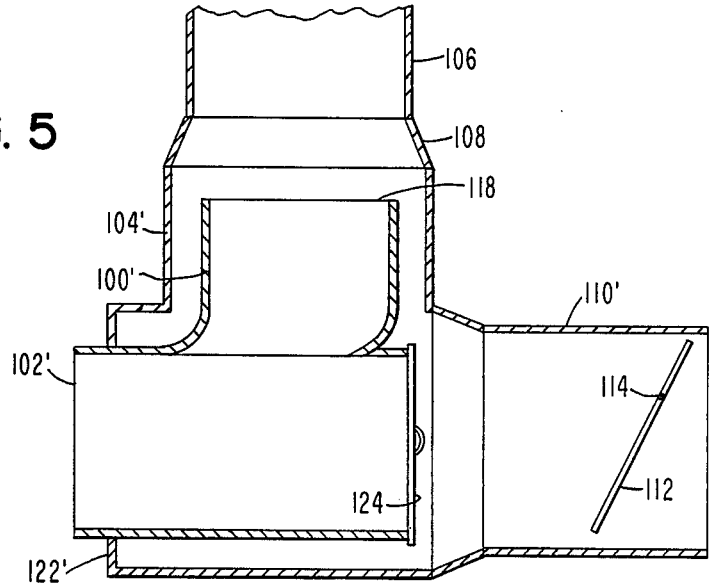
Figure 4A:
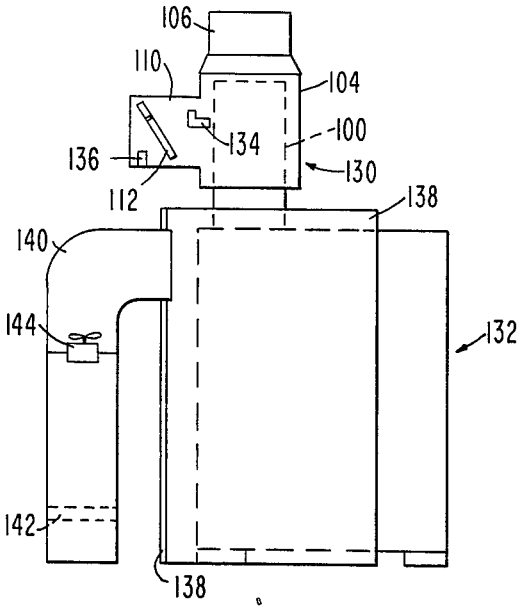
Figure 6:
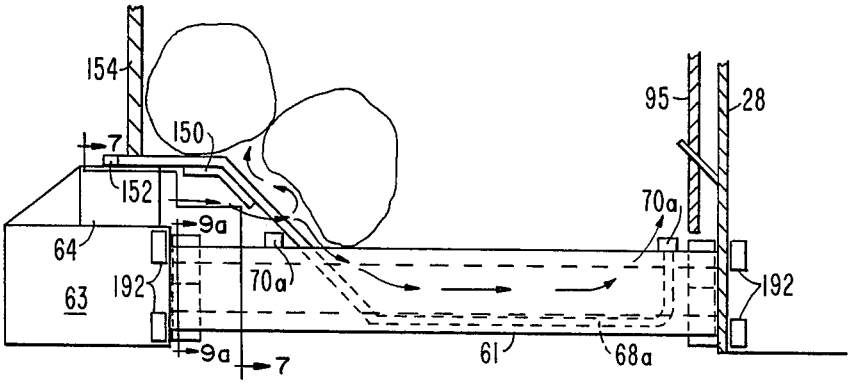
Figure 7:
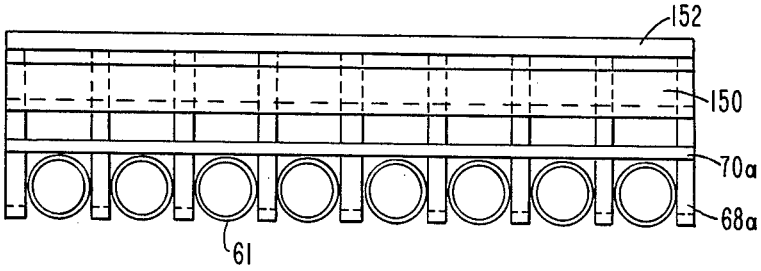
Figure 8:
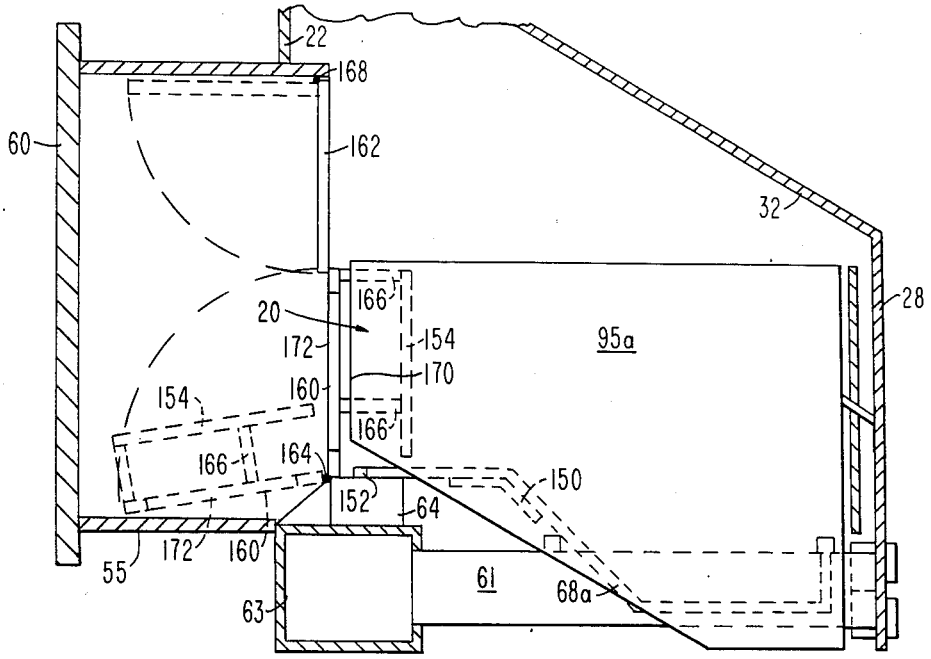
Figure 9A:
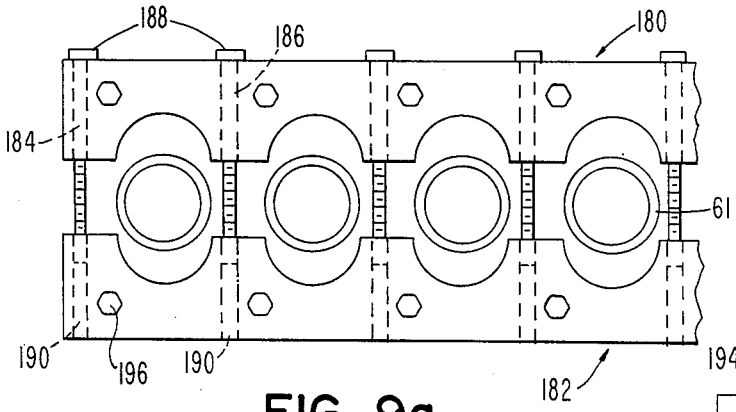
Figure 9B:
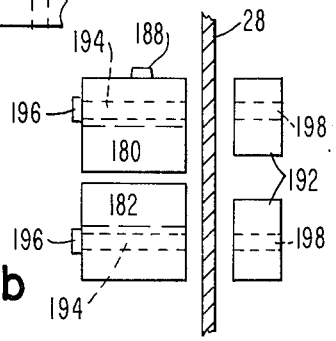

FIG. 4*a* is a somewhat schematic and side-elevational view of an adaptation of the component of FIG. 4;

FIG. 5 is a view similar to FIG. 4 but with a different orientation and arrangement of the elements;

FIG. 6 is a cross-sectional view of an improved grate assembly for use in the apparatus of FIGS. 1-3;

FIG. 7 is a fragmentary cross-sectional view taken along the line 7—7 in FIG. 6 and with certain components removed;

FIG. 8 is a fragmentary cross-sectional view taken similarly to FIG. 3 but showing improvements included in the apparatus thereof;

FIG. 9*a* is a fragmentary and enlarged cross-sectional view taken along the line 9*a*—9*a* in FIG. 6;

FIG. 9*b* is a fragmentary and exploded side-elevational view of components shown in FIGS. 6 and 9*a;*

Figure 10:
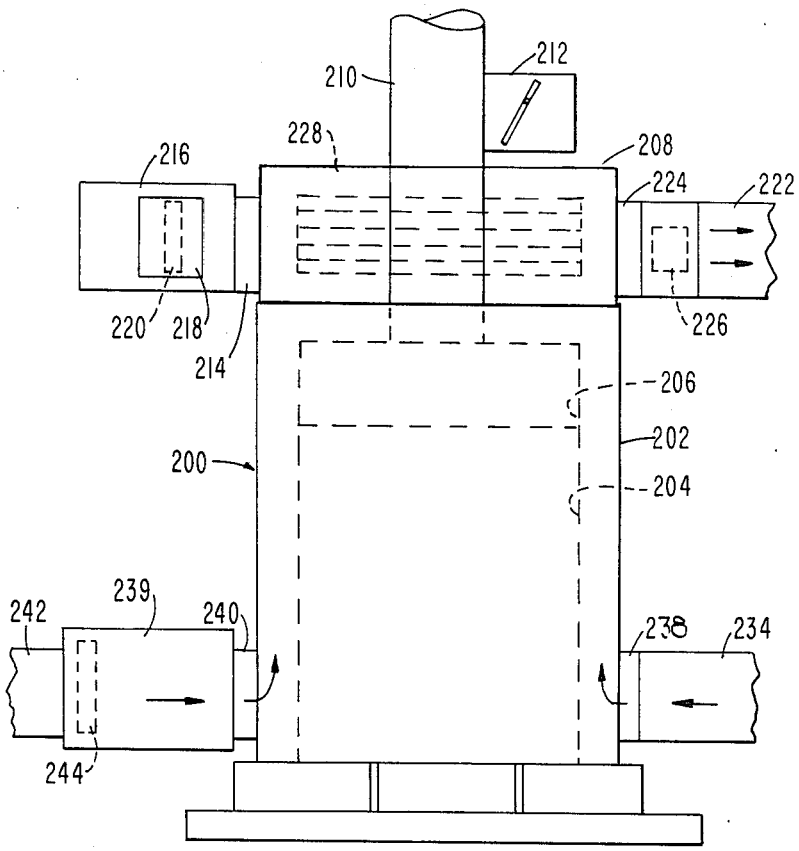
Figure 11:
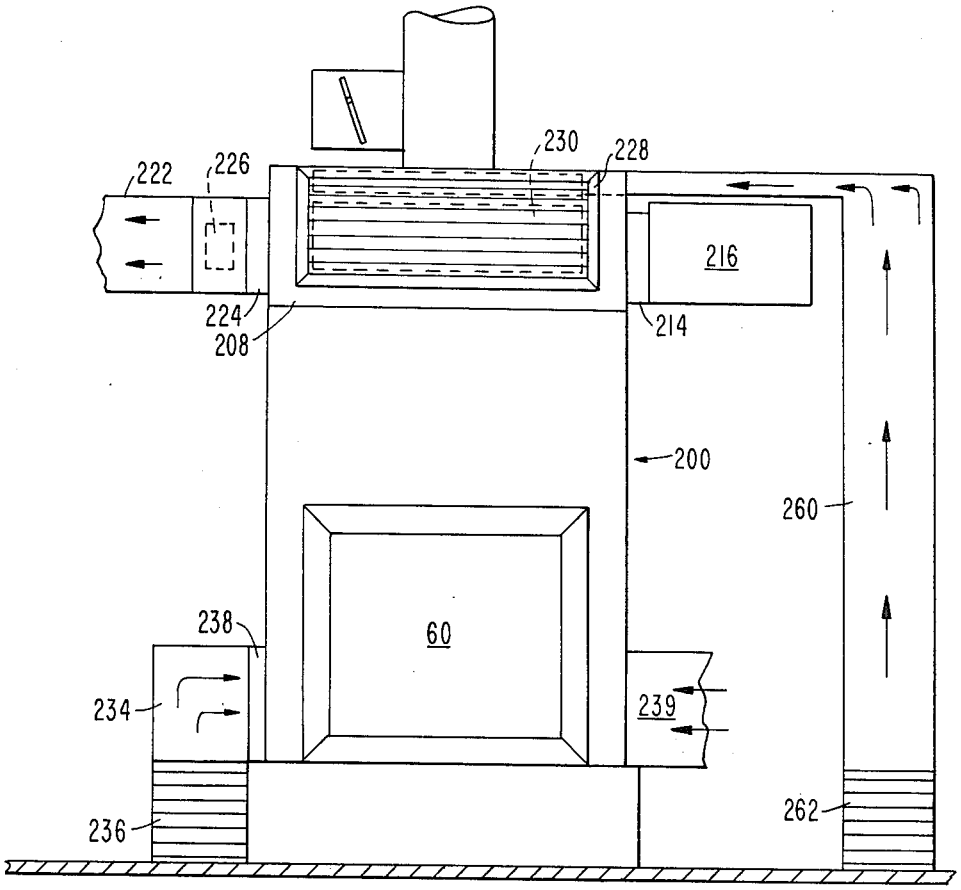
Figure 12:
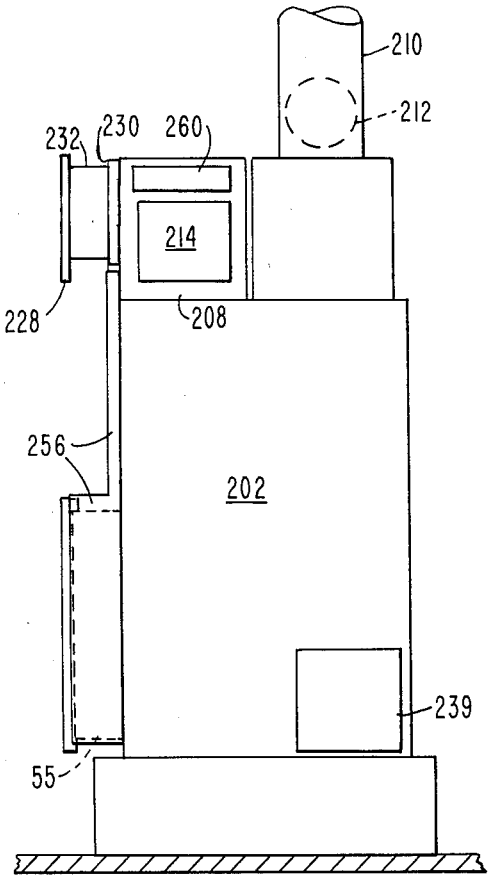
Figure 13:
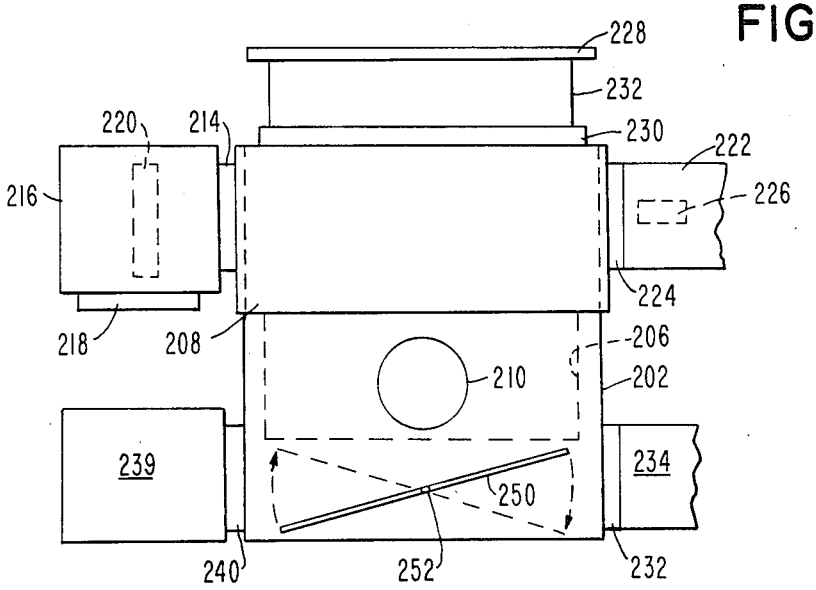
Figure 14:
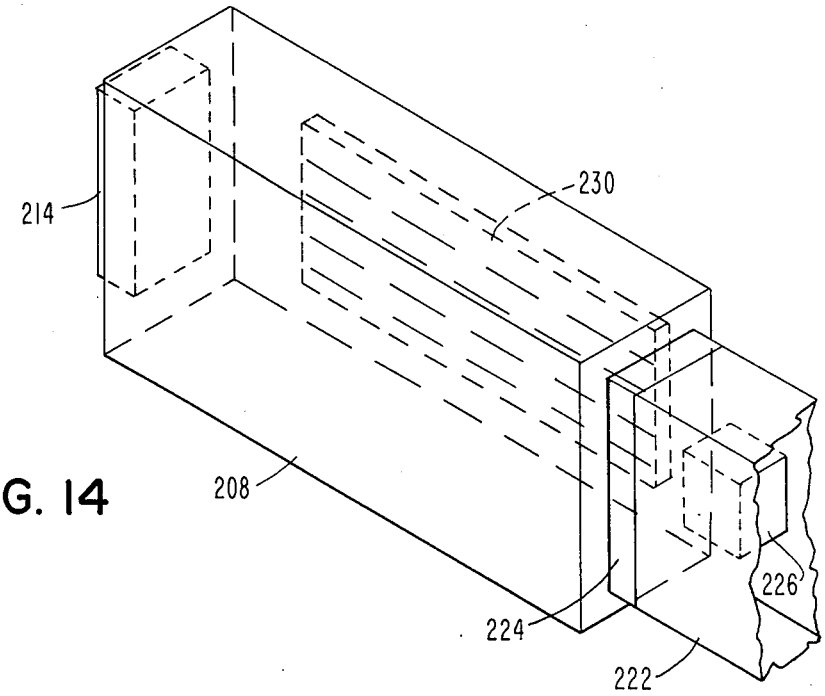
Figure 15:
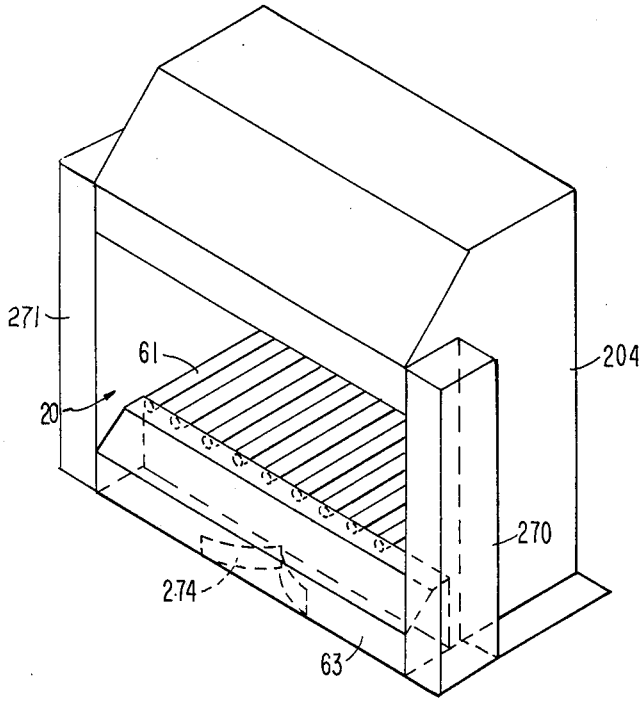

FIG. 10 is a somewhat schematic rear-elevational view of a damper and duct system added to the fireplace system of FIG. 1;

FIG. 11 is a similar front-elevational view of the system of FIG. 10;

FIG. 12 is a similar side-elevational view of the system of FIG. 10;

FIG. 13 is a similar top plan view of the system of FIG. 10;

FIG. 14 is a fragmentary isometric view of a portion of the system of FIG. 10; and FIG. 15 is an isometric view of a system similar to that shown in FIG. 1 but with the inclusion of a further The improvements to be described are herein presented relative to the apparatus described in the aforesaid U.S. Pat No. 4,026,263. Accordingly, that patent is incorporated herein by reference. Moreover, FIGS. 1–3 of this patent application correspond, with one exception, to FIGS. 1, 2 and 10 of that patent. In order to gain an understanding of the overall aspects, this description proceeds first with what, therefore, may be a redundant discussion of the subject matter of that patent.

A fireplace system includes a firebox 20 formed of a heat-conductive material such as sheet steel. Firebox 20 confines a region of combustion of burnable products such as firewood. In itself, firebox 20 includes a front wall 22 bridging sidewalls 24 and disposed vertically over its lower portion but slanting inwardly and upwardly over its upper portion 26. A rear wall 28 is vertically disposed over its lower portion and is formed to slant upwardly and forwardly throughout its upper portion 32. Additional wall sections serve to define a smoke shelf 42.

Opening upwardly from smoke shelf 42 is an exhaust outlet 44 for conveying the combustion products on through the usual chimney or stack 45. Slanting upwardly and forwardly through the region of shelf 42 are a plurality of conduits 46. A baffle sheet 48 slants upwardly and generally alongside the uppermost surface of conduits 46. Another baffle 50 projects upwardly but has its margins spaced from the sidewalls so as to permit upwardly rising smoke to egress through outlet 44 around the edges of this particular baffle. Baffle 50 chokes off the central region of the smoke path, preventing backward eddy currents.

Defined in front wall 22 is an opening 52 through which fuel to be consumed is inserted and ignited. Opening 52 is aligned with an opening in an outer jacket 54 that encloses firebox 20. A collar 55 has an out-turned flange which is fastened and sealed around and to the margins of the latter opening, while defining a door holder flange 56. A door frame 58, carrying a pair of sliding fire doors 60 that preferably are composed of transparent glass, is secured to flange 56. As illustrated, frame 58 is spaced by collar 55 from jacket 54 by a distance to accommodate the brick or stonework that forms the aesthetically attractive wall through which the fireplace opens.

In the manner shown, collar 55 is removably affixed to jacket 54. This reduces the clearances necessary to move the main part of the fireplace unit into a given enclosure. Both its front and rear flanges enable air-tight sealing to associated surfaces, for reasons better to be appreciated in connection with the description of operation included in the aforementioned patent. Flange 56 also defines out-turned surfaces that serve as a guide for the laying of brick or stone. A baffle 59 projects downwardly and rearwardly of the top panel of collar 55 for the purpose of preventing an internal circulating current of smoke toward fire doors 60. Desirably, collar 55 may be circumscribed by a sleeve of insulating material.

A plurality of laterally-spaced tubes 61 are oriented so as to open at one end 62 through the lower portion of rear walls 28 and emerge at the other end into a manifold 63 which runs crosswise along the bottom of opening 52. Also running transversely to opening 52, generally along its lower portion and spaced somewhat inwardly thereof, is a pipe 64 through the back surface of which is defined a plurality of longitudinally-spaced combustion air outlets. A strut 66 extends between the front-top edge of pipe 64 and the upper wall of manifold 63 for both strength-giving and appearance purposes. A series of small apertures are spaced along the upper surfaces of pipe 64 so as, in use, to form: an air screen.

Successively spaced individually between different ones of tubes 61, and oriented near the lower, portions thereof, are a plurality of bars 68 which serve to collect ignited coals and retain the same in a position adjacent to the tubes. Bars 68 are suspended by a plurality of straps that depend from a pair of rods 70 disposed transversely across the top of tubes 61 respectively near the front and rear thereof. Bars 68 each so fill the space between adjacent ones of tubes 61 as to hold embers until they are reduced at least substantially to ashes.

As herein contemplated, the entire area beneath the grate defined by tubes 61 is opened to an underlying ashpit, although that is not necessary. The desirability of using such an open ashpit is described more fully in the aforementioned patent.

Outer jacket 54 encloses firebox 20. Jacket 54 is in itself a similar metallic enclosure the walls of which are generally spaced from the walls of firebox 20. Jacket 54 defines or accommodates front opening 53, outlet 44, manifold 63, pipe 64, an air return inlet 71 and a heated-air plenum opening 72. However, jacket 54 may be constructed during installation of a fireplace so as to be composed of brick or stone materials. In any event, a variety of heat-conductive spaced-apart fins preferably project outwardly from firebox 20 and into the space defined by jacket 54. Those fins, such as 78 herein shown and others illustrated in the patent, increase heat exchange with air circulated within jacket 54. Also in accordance with the discussion in the aforesaid patent, one mode of adaptation of the present invention involves use of baffles 82 and 83, deflector assembly 84, with its vanes 85 and 86 and web 88, and the related apparatus described in that patent.

As also described in the prior patent, firebox 20 rests on a baseplate 89 that has a member across its front and two rearwardly extending legs at either side. Upturned edge margins accommodate jacket 54. The central open space within baseplate 89 is above the ashpit. During installation, all exposed marginal joints are sealed with asbestos cement. That same structural approach may be continued in connection with the present improvements.

Also secured on the interior surfaces of sidewalls 24 and rear wall 28 are pairs of spaced vertical brackets 93 from which project upwardly slanting posts 94. Lending protection to those walls are respective fireplates 95 that have apertures to receive posts 94 and which are so located as to position the fireplates at the corresponding ends and the back of burning logs. That approach is retained hereinafter. However, and as will be further described, fireplates 95 desirably are revised so as to serve additional purposes.

Projecting laterally from stack 45, as shown in FIG. 1, is a barometric damper 96 which, in itself in the patent, was conventional. That is, it has an internal valve flap 97 that is counterweighted so as normally to enable just enough stack suction from the firebox to remove the combustion products. Flap 97 opens further to let in additional air when high wind across the top of the stack increases the updraft. In the system of the patent, damper 96 communicates with a source of air from outside the enclosure or space being heated. As is to be described below, that damper arrangement is herein improved upon.

The aforesaid prior patent also teaches use of thermostat means within the enclosure being heated for enabling and disabling certain control means in response to temperature change. Such control means serve to govern the conveyance of air from an outside source to the firebox itself, to the circulation system for heated air or to both. Basically, those features preferably are retained in connection with what yet is to be described. On the other hand, the improvements connected with the discussion hereinafter also find utility in systems that may be quite different from those which derive from the aforesaid patent.

In FIG. 4, an inner tube 100 has its inlet or lower end 102 leading or secured to the combustion chamber defined in principal part by firebox 20. An outer tube 104 encircles tube 100 and is coupled at its upper or outlet end into a stack 106 by a connection section 108. A conduct 110 opens laterally through the wall of outer tube 104. A weighted damper 112 is secured by a pivot at 114 within conduit 110 and in the path of air inletted through the outer end 116 of the conduit. In itself, damper 112 is a vane which, in the conventional manner, is eccentrically weighted so as to open normally just enough to accommodate upwardly-directed suction forces within stack 106 that exceed those desirable for maintaining adequate and proper combustion within firebox 20.

As illustrated, the outlet or upper end 118 of tube 100 extends upwardly above conduit 110, so as to dispose its upper end 118 at an elevation greater than the elevation of the uppermost side of conduit 110. At the same time, outlet end 118 is disposed below outlet end 120 of outer tube 104. Moreover, outlet end 118 in this case preferably has a width which is less than the width of stack 106. As accommodated by the inclusion of coupling or transitional section 108, the outlet or upper end of outer tube 104 has a width which is greater than the width of stack 106.

At a location between conduit 110 and firebox 20, in this case physically below the elevation of the lowermost portion of conduit 110, is a wall 122. Thus, the only air that can be drawn through the space between tubes 100 and 104 upwardly into stack 106 has to be inletted through conduit 110.

As used on a system of the kind depicted in FIGS. 1–3 installed to serve as the primary source of heating that served a residence having approximately 1200 square feet of floor area, an arrangement in accordance with FIG. 4 was such that inner tube 100 had a diameter of 10 inches, stack 106 (the flue in the chimney) had a diameter of 12 inches, conduit 110 also had a diameter of 12 inches, and outer tube 104, correspondingly, had a diameter of 14 inches. The weight upon damper 112 was adjusted in position so that, in the absence of significant wind across the top of stack 106, combustion within firebox 20, without the additional forced input of outside air, there is just enough draft to avoid smoking with the door to the firebox open.

The alternative shown in FIG. 5 adapts the principles implemented in the arrangement of FIG. 4 to the receipt of gases from firebox 20 delivered in a horizontal, rather than a vertical, direction. Thus, inner tube 100' receives the input from the combustion chamber at an inlet end 102' from which the inner tube turns, in an L-shaped manner, so as to again project its outlet end 118 in an upward direction. Correspondingly, outer tube 104 is conformed in an L-shaped manner so as to have horizontal and vertical legs. The outlet end of conduit 104' once again connects through a coupling 108 to stack 106. Conduit 110' connects into the upright leg of conduit 104'. Included in the upright leg portion of inner tube 100' is a removable closure 124 that is accessible through conduit 110 upon the disengagement of damper 112. That may serve as a convenient cleanout for the removal of deposits within the horizontal leg of inner tube 100'.

A damper arrangement as shown in either of FIGS. 4 and 5 contributes greatly to efficient and safe operation. The suction or draft effected within the stack by chimney action depends upon prevailing temperatures and the size of the stack. Those parameters are subject to extreme variation even in normal operation. Appliances, that use wood or a similar solid fuel, are controlled as to the amount of draft by using dampers either in the flue or at the point at which air enters into the firebox. That control requires a degree of knowledge and judgment for proper use. Even under the best of conditions, there often is an improper venting in the chimney. As a result, there frequently is a buildup of soot and creosote on the internal walls of the stack. Such materials have led to the occurrence of a fire within the stack.

The conventional barometric damper, as illustrated in FIG. 1, is intended to adjust the amount of draft through the stack so as automatically to accommodate the air flow needs within the firebox while yet allowing sufficient draft through the stack. Even in the case of the occurrence of a fire within the stack, the damper arrangement is supposed to open in order to allow a burning-out of the soot or creosote without increasing draft through the firebox. However, in order to provide a stack, for an appliance that burns wood or the like, large enough to vent the smoke from the burning of a fire at full capacity, conventional design calls for assigning a size to the stack of about twice as large as that needed for more normal burning conditions. On the other hand, that excess capacity often allows a portion of the air that enters the stack to circulate down to the fire and undesirably interfere with proper operation.

In the embodiment of FIGS. 4 and 5, the use of the smaller-diameter inner tube 100, that extends beyond conduit 110, inhibits such undesired downward flow. The larger size of outer tube 104 serves to allow damper 112 better to adjust the amount of suction through the entire assembly. The illustrated arrangement allows air to enter the stack in order to increase the decomposition of combustible material in the smoke originating from the firebox, while still automatically compensating for increased chimney action. Should the desired combustion within the firebox be reduced, even deliberately, to a point that causes the emission of an increased quantity of unburned particles, the action of flow through conduit 110 is such as to assist in the proper venting of those unburned particles without affecting the action within the firebox itself. Air entering through conduit 110 soon dissipates the additional heat that develops as a result of any burning of soot or creosote within the stack. As a result, temperatures within the stack tend to return soon to normal temperature.

Stated another way, the flow up the stack contributed through conduit 110, when the combustion within firebox 20 is purposely throttled down, is sufficient to carry any creosote on outwardly from the stack in most circumstances and yet also serves, should there be ignition of a collection of such substance within the stack, to allow the increased draft to complete that ignition at an early stage and without affecting draft upon the firebox itself. Furthermore, the new barometric damper arrangement shown tends to result in a saving of fuel supplied to firebox 20, because it reduces the amount of heat lost up the stack.

It is to be noted that the barometric damper systems of FIGS. 4 and 5 find utility as used on any heating unit, stove or the like that burns a solid fuel such as wood. In use, it serves well to separate the functions of control of draft through the firebox, on the one hand, and the control of the provision of adequate air through the stack or chimney, on the other hand.

In FIG. 4*a*, a barometric adaptor 130 is in itself constructed in the manner of FIG. 4 and is adapted to a free-standing stove 132. Included in conduit 110 and located near inner tube 100, or otherwise disposed so as to sense the temperature in the vicinity of tubes 100 and 104, is a high-limit electric switch 134. Switch 134 is wired in series with an electromagnet 136 to a source of operating power. Magnet 136 is disposed within conduit 110 in a location to attract, and lock into its closed position, pivoted damper vane 112 when the magnet is energized through switch 134. Switch 134 has normally-closed contacts that open when the sensed temperature rises to a pre-selected limit. When the fire is out inside stove 132, therefore, switch 134 remains closed and damper vane 112 is held in a closed condition so as to prohibit the undesired loss of heat up stack 106. After the fire has been started, and the flue temperature warms up to the pre-selected value, switch 134 breaks the circuit to electromagnet 136. It will also be noted that, if the supplied electrical power ceases, the damper is automatically released.

In the particular embodiment of FIG. 4*a*, a shroud 138 partially encircles and is spaced from the rear and sidewalls of stove 132. A pipe 140 is coupled at one end through shroud 138 and at its other end receives air from outside the space being heated by stove 132. Included in the inlet of pipe 140 is an electromechanically-operated damper 142. Also disposed within pipe 140 is an electrically-operated fan or blower 144. When fan 144 is energized to draw air through damper 142, that air is caused to circulate around and outwardly into the space being heated from stove 132. As a result, the overall heating system features the addition to the space of fresh air and a positive pressure is created within that space. As explained in the aforesaid patent, the production of heated air so as to create a positive pressure within the space serves to prevent leakage into the space of unheated outside air around doors, windows or other cracks.

In the prefered arrangement of the system of FIG. 4*a*, damper 142 is also powered through switch 134 so that damper 142 is maintained in a closed position until the flue or stack temperature reaches the pre-selected value at which switch 134 opens. Similarly, fan 144 preferably also is powered in response to operation of switch 134. In that case, however, switch 134 additionally includes a pair of normally-open contacts in series to the source of electrical power with fan 144. Thus, fan 144 is energized to draw outside air through pipe 140 only when the flue or stack temperature reaches the activation level of switch 134.

In case of power failure, fan 144, of course, is inoperable. At the same time, nevertheless, damper 142 automatically opens so that outside air is inletted by gravity flow. If desired, a manually-operated disconnect may be included in series with the wiring of fan 144 so as to preclude the powered drawing of outside air at such times as it may be desired to recirculate, or heat by convection only, the air already contained within the space being heated. In addition, a manually-operated override control may be included on damper 142, so as to force that damper to remain in an open condition during times of power failure or when it otherwise is desired to insure the admission of outside air.

In the original embodiment of the heating system as depicted in FIGS. 1–3, grate tubes 61 were welded at the rear ends into openings provided in rear wall 28 and at the front ends into corresponding openings formed in a wall of manifold 63. During ordinary operation with conventional wood fuels, the flexibility of the connecting walls adequately accommodated the effects of thermal expansion and contraction in grate tubes 61. At the same time, the bars 68 of the additional drop-in grate assembly, which serve to catch live coals and hold them adjacent to tubes 61, effected what was a rather substantial barrier to the free flow of air in and around tubes 61. In time, and particularly when using pieces of wood for fuel that burned at very high temperatures and when the system was operated at maximum burning capacity, some failures occurred at the point of welding of tube 61 into the corresponding walls. This is believed to have been a result of diversion of the combustion air stream from the burning fuel back onto and down the front of manifold 63. In addition, that air stream channeled itself under the burning fuel and rose upwardly alongside rear wall 28 and behind firewall 95. The new embodiments for the drop-in grate bars as shown in FIGS. 7 and 8 overcome those deficiencies.

As shown in FIGS. 6 and 7, bars 68*a* again are joined into an assembly by supports 70*a* so that the bars are seated individually between corresponding ones of tubes 61. However, bars 68*a* are conformed at their forward end portions to seat above manifold 63. In addition, a shield 150 closes the spaces between all of the forward end portions of bars 68*a* and is so positioned as to block the flow of combustion air onto manifold 63. An additional crosswise bar 152, laterally connecting the forward ends of all of bars 68*a* and disposed above manifold 63 and pipe 64, serves additionally as a barrier to the flow of hot combustion air downwardly and back to the rear toward rear wall 28. At the same time, bar 152 also serves, in cooperation with an andiron 154 to be described further, the purpose of preventing the drop-in grate assembly, that includes bars 68*a*, from sliding too far to the rear and thereby exposing a greater portion of pipe 64 and manifold 63.

In the original embodiment of FIGS. 1–3, a primary purpose of glass doors 60 is to separate combustion air, supplied from the outside, from air circulating within the space being heated. It has been found, unfortunately, that at least most conventionally-available glass-door assemblies permit an undesirable degree of leakage. That leakage allows air to be supplied to the process of combustion from the space being heated. It also tends undesirably to create a circulation of air from the combustion area back toward the glass doors. The result has been an interference with proper control of the process of combustion and also the creation of excessive heat near the top of the glass doors.

In the modification illustrated in FIG. 8, such problems are prevented, or at least largely overcome, by the inclusion of a gate 160 and a damper 162 both of which are spaced inwardly from glass doors 60 at the rear of frame 55 and preferably just slightly further to the rear behind front wall 22 of the firebox. Gate 160 and damper 162 together serve as an enclosure assembly located between sliding door assembly 60 and the combustion chamber. Gate 160 is hingedly affixed along its lower portion at 164 from the assembly of manifold 63 and so as to be swingable to a more-forward and open position as shown by a dashed line in FIG. 8.

Laterally spaced andirons 154 are secured to the rear side of gate 160 by struts 166. Gate 160 thus is openable to permit the insertion of fuel through doors 60 and into the primary burning portion of chamber 20. When gate 160 is in its open position, the andiron structure projects upwardly so as to assist in the loading of fuel, such as logs, into the combustion chamber.

Damper 162 is hinged along its upper edge at 168 to front wall 22 at the rear of frame 55. That permits damper 162 to be swung outwardly and upwardly. Damper 162 slightly overlaps gate 160 so as to complete an inner-door assembly. Being located above gate 160, damper 162 is disposed to prohibit the passage of air, through leakage in the door assembly, over and upwardly away from the primary combustion area in chamber 20. A simple latch, not shown, preferably is included to permit holding damper 162 in an open position. Damper 162 serves to prevent inner circulation when it is in the closed position and also tends to prevent the build-up of excessive heat, whether closed or open, from being transmitted to the upper portion of frame 55.

In the original embodiment of FIGS. 1–3, the basic combustion chamber and overlying plenum area was in the form of a rigid shell composed of front wall 22, rear wall 28 and sidewalls 24. Firewalls 95 were disposed in spaced position inside that rigid shell to absorb the effects of the highest temperatures produced within the primary combustion area. In the embodiment of FIG. 8, that principle is retained. In addition, however, plates 95*a*, along the sides of the primary combustion area, are extended forwardly, toward door 60, so as to define a forward margin 170 spaced closely adjacent to the rear edge margin of gate 160. That relationship serves to form a shield or channel that diverts any air, that is drawn in or around the lateral edge margins of gate 160, upwardly toward the plenum area instead of into the primary combustion area. In lieu of extending firewalls 95*a* so far forward, a channel may be formed with respect to and project from the respective ones of sidewalls 24 so that any air, which tends to leak around the sides of gate 160, is directed upwardly toward the plenum chamber instead of feeding the fire.

When electrical power is lost for operating the various blowers described in connection with the heating system of FIGS. 1 and 3, and that system has been modified to include the features of FIG. 8, the opening of gate 160 may be accompanied by the placing of damper 162 in the closed position while leaving glass door 60 open. Damper 162 then serves to direct the air entering the unit from the space being heated down into the primary combustion area in order to obtain adequate burning in the absence of blower operation. Desirably, a tempered glass panel 172 is centrally located within gate 160 so that the user may view the flames of combustion through glass door 60.

As mentioned above, a few of the original heating systems constructed in accordance with FIGS. 1–3 have encountered difficulty with a fracture of welds at ends of grate tubes 61. In addition, the long-term operation of any form of conventional grate tube entails a gradual deterioration of the walls of the tube. Eventually, therefore, such tubes need replacement. Whether retrofitting existing units or employed in the fabrication of new units, the arrangement particularly illustrated in FIGS. 9*a* and 9*b* is advantageous. In that approach, a pair of facing U-shaped clamps 180 and 182 are sized to grip an end portion of a tube 61. A first pair of holes 184 and 186 are defined in the respective legs of each clamp 180 to face the mating clamp 182. A fastener 188 is engageable through holes 184 and 186 so as to secure the clamps together. In this case, fasteners 188 are bolts that fit through holes 184 and 186 into corresponding threaded holes 190 provided in the mating clamp. Other forms of known fastening elements may, of course, be substituted.

In any case, there also is a retainer 192 disposed on the side of the securing wall opposite at least one of clamps 180 and 182. Additional, longitudinally-directed, holes 194 in the clamps receive bolts 196 that are threaded through the securing wall into threaded holes 198 provided in retainer 192. Regardless of the specific manner of fastening as between the three different basic parts, the objective secured is that of removably securing the respective end portions of tubes 61 to the upright walls at the respective opposing ends of the grate tubes.

As described in the aforesaid patent, the heating system of FIGS. 1–3 was adaptable for use in a variety of different applications, including modification of an existing fireplace system, installation as a discrete fireplace unit associated with nearby air outlets that circulated heated air into the room within which the unit was located or as tied into a duct system that supplied the heated air to all or part of an entire building as in the manner of a conventional furnace. In adapting the system of the patent for the supply of heat to a single room, the manner of installation is similar to that of installing a number of known prior fireplace units that employ an enclosing shell which includes the formation of heat-exchanging passages for circulating heated air, from externally of the firebox, into the room. As in those prior units, the exchange of heat may be accelerated by including a blower in the system. At the same time, the location of any outlet duct above a return colder-air duct allows such a system to operate by gravity flow in the absence of a blower or in the failure of operation of an included blower by reason of power failure.

When, however, a system of the positive-air supply kind, as above described in connection with FIGS. 1–3 or as modified in accordance with the improvements of the further description above, is employed with an external ductwork system that leads throughout the enclosure, problems of proper air flow may be encountered. A particular problem is encountered whenever power is lost so as not to be available for operation of blowers or it otherwise is desired to operate the heating system by gravity flow.

In general, a safe installation requires that circulating heated air should not be able to get into the ductwork, at least throughout the total enclosure, without the use of blowers. Otherwise, an excessively "hot spot" might be developed. That has been assured in the past, when duct-work leads outwardly from such a unit, either level with or above the combustion chamber, by installing a conventional back-draft damper. That serves to prevent hot air from entering the ductwork by gravity flow. A more severe situation may be presented when the ductwork is installed so as to lead down the side of and to a point below the heating unit. That arrangement may create an air trap that prevents hot air from flowing into the ductwork. In that case, the heating system itself may encounter the creation of dangerously high temperatures, because of the fact that the heated air may be unable to escape. The connecting ductwork arrangements of FIGS. 10–14 obviate such deficiencies, difficulties and problems.

This new system preferably, although not necessarily, includes a fireplace system constructed in the manner of the system of FIGS. 1–3 modified to include the improvements of FIGS. 4–9. It thus includes a fireplace unit 200 that has an outer jacket 202 spaced from but enclosing a firebox 204 above which is a smoke shelf 206 and a hot-air plenum chamber 208. A stack 210, provided with a barometric damper 212, projects upwardly from smoke shelf 206 as a chimney.

Opening into one side of plenum chamber 208 is an inlet damper 214. Damper 214 leads from a plenum 216 provided with an air entrance controlled by another damper 218. Damper 218 communicates, either directly or indirectly, with air supplied from outside the space being heated. To force the introduction of that outside air, a blower 220 may be included within plenum 216. Where the mode of installation permits, however, an equipment or furnace room is disposed behind fireplace unit 200, houses all blowers, and is separated with respect of air circulation from the space being heated. That room then includes an inlet opening to the exterior of the building for admitting outside air which may become somewhat warmed as it travels through this furnace room. In that case, damper 218 may be relocated so as actually to govern the control of air from the outside of the building into such a furnace room.

Leading outwardly from the other side of plenum chamber 208 is a duct 222 which supplies the overall ductwork system that leads to the hot-air registers distributed throughout the different rooms of the interior space to be heated. At that outlet from plenum chamber 208, which supplies air to duct 222, there is a damper 224 just beyond which, into duct 222, is a temperature sensitive switch control 226.

Projecting outwardly from the front of plenum chamber 208 is a grill 228 behind which is another damper 230. In this case, grill 228 is spaced outwardly by a collar 232 that accommodates masonary work or the like for aesthetically completing the fireplace installation in the conventional manner.

Leading into one side of the lower portion of jacket 202 is a gravity air return duct 234 which extnds from a grill 236 mounted on or near the floor in the room of the interior space in which unit 200 is located or, alternatively, in a similar location in some other portion of the total interior space to be heated that affords good circulation for gravity flow. Duct 234 outlets through a damper 238 and through jacket 202 into the space between the latter and firebox 204.

At the other side of the lower portion of unit 200 is a plenum 239 which feeds circulating air through a collar 240 and the wall of jacket 202 again into the interior space between jacket 202 and firebox 204. Plenum 239 leads from the normal cold-air return ductwork system 242 distributed throughout the different rooms of which the interior space to be heated is composed. Although it may be located elsewhere, a circulation blower 244 for the overall interior circulation system is indicated as herein included conveniently within plenum 239.

In the illustrated system, blower 244 corresponds in function to circulation-air fan 108 of the aforesaid patent. Analogously, blower 220 corresponds to fan 34 of that referenced patent. Moreover, the same thermostatically controlled system, as explained in connection with FIG. 9 of that patent, advantageously may be employed in connection with the operation of the herein heating system of FIGS. 10–14.

Dampers 214, 224, 230 and 238 all may be constructed in the same manner. That is, each is composed of a vertically-spaced succession of horizontally-oriented longitudinal slats each of which is in turn pivoted to rotate about a horizontal axis, with all of the slats in a given damper being ganged together. The slats are so spaced vertically that, when all are pivoted to a vertical orientation, the mutually overlap sufficiently to close the opening. Upon pivoting of the slats into a near-horizontal position, on the other hand, the damper is opened. For automatic self-actuation in response to air movement, each gang of slats is limited in movement to short of a full horizontal position. Thus, those dampers which are normally open, in the absence of the flow of air in a forward direction, are so arranged that their inlet margins swing upwardly to a closed position under air pressure, while the slat gang falls downwardly and outwardly to an open position in the absence of the air. A reverse mode of operation is obtained simply by inverting such an assembly. That is, in absence of flowing air, the downstream and outermost margins swing downwardly so as to dispose the slat gang in a closed orientation. On the other hand, a flow of air from the rear of the slat assembly serves to open these slats.

In the illustrated embodiment, dampers 214 and 224 are normally in a closed position. On the other hand, damper 230 and 238 are normally in an open position; any movement of air developed by a corresponding blower serves automatically to close the normally-open dampers.

Damper 214 serves the primary purpose of acting as a check valve to prevent the backflow of warm air from escaping to outside the space being heated. Damper 224 prevents air from flowing into ductwork 222 unless blower 244 is operating so as to cause intentional circulation throughout the entire space being heated. Being normally open, damper 230 permits heated air to flow into the room in which unit 200 is located under gravity flow, but that damper closes when circulation blower 244 begins to operate. Damper 238, which is normally open, allows a greater flow of air to enter the unit and be circulated than otherwise would be the case when circulation blower 244 is de-energized so that all heat is by virtue of gravity flow. That increased flow of air occurs by reason of the fact that blower 244 is in itself a restriction in the return-air ductwork. It also bypasses the blocking effect of the usual back-draft damper installed in the return air duct when the overall heating system is installed in parallel with some kind of conventional furnace. It may be noted that damper 224 also serves as a back-draft damper with respect to the paralleled conventional furnace when the latter unit is operating instead of unit 200.

Damper 218 is normally open and is located on the suction side of the outside air blower supply system and ahead of damper 214. Thus, damper 218 allows make-up or pressurizing air to enter the furnace-room-type of installation unless the ultimate outside air blower is turned on, in which case that latter blower furnishes the make-up air.

When a fire is first ignited and heat begins to be produced, air is circulated through damper 238 from within the space being heated. That circulated air passes through unit 200 and back into the interior space through damper 230. In the absence of available electrical power, that mode of operation would continue. With power available, however, this gravity-flow mode of operation continues only until the heat produced brings unit 200 up to a pre-selected temperature, such as 150° F., at which point circulation blower 244 automatically is energized in accordance with the teachings of the aforesaid patent.

The pressure of air forced to circulate by blower 244 automatically effects the closing of dampers 230 and 238, while damper 224 automatically opens so that air returned through ductwork 242 is fed through unit 200 in heat-exchanging relationship and distributed throughout the interior by way of ductwork 222. Thermal sensitive switch 226 preferably is adjusted so that when the heated air temperature, as measured at the entrance to ductwork 222, exceeds a value of approximately 180° F., outside air supply blower 220 is energized to operate at a lower speed. Upon the beginning of operation of blower 220, damper 230 automatically closes and damper 214 opens itself to allow cooler air to enter plenum 208. Preferably, thermal-switch 226 is of a two-stage variety, including a second pair of switch contacts that automatically activate air blower 200 into a still higher speed of operation when the sensed temperature exceeds a yet higher value such as 200° F.

In the manner of the system of the prior patent, and although not shown in FIGS. 10–14, operation of the circulation air system also contemplates operation of the combustion air supply system which also has an outside source. Thus, the signal representing temperature as sensed by switch 226 may be incorporated in the combustion air supply system in order to shut off that air blower after interior space temperature has been reached, so as thereby to enable the rate of combustion to subside When firebox 204 has cooled sufficiently that the temperature is back to the exemplary value of 150° F., circulation blower 244 is de-energized, damper 224 thereupon closes, and dampers 230 and 238 open so that unit 200 operates under a graviy-flow condition. If that is insufficient to maintain interior space temperature, the thermostatically-controlled system of the prior patent serves to energize the combustion-air blower and achieve a repeat of the heating cycle.

It may be noted that jacket 202 and plenum chamber 208 are so constructed as to permit the different systems to be connected to either side of the unit as is most convenient for a given installation. That is, damper 224 and ductwork 222 may be exchanged in position wit damper 214 and plenum 216. Similarly, damper 232 and its duct 234 may be interchanged in location with adaptor 240 and plenum 239. In this connection, adaptor 240 desirably may include adjustable air-directing vanes that may be set, regardless of which side of unit 200 is connected to the adaptor, for directing the circulated air most favorably to spread over the exposed surfaces of firebox 204.

Also supporting such interchangeably, as between opposite sides of unit 200, is a deflector 250 pivoted centrally at 252 and located in the space behind firebox 204 and yet inside jacket 202. Generally, deflector 250 serves the same purpose as deflector assembly 84 shown in the aforesaid patent and in FIG. 3. In this case, however, deflector 250 may be adjusted about pivot 252 so as to be in the most appropriate position depending upon which side of unit 200 is fed from plenum 208. Otherwise, deflector 250 may be structured in the same manner as deflector assembly 84 of the patent.

As shown in FIG. 12, a shield or cover 256 preferably is included to enclose door extension or frame 55 on both sides and the top and then extend on up the front of the unit into plenum 208. Shield 256 serves to gather heat from the door-frame area and discharge it into the room through the front opening of the plenum.

As shown only in FIG. 11 for clarity, an additional duct 260 preferably is included to lead from another floor register 262 and continue into the region above plenum 208 and at a location above the discharge opening of the plenum through damper 214. Duct 260 provides a layer of room temperature air between the heated air being discharged ffrom plenum 208 and the overlying ceiling of the room. When operating of gravity flow, particularly when that operation is the only mode available during lack of electrical power, the additional layer of room air above the plenum assists in preventing excessive heat from rising into the ceiling area. Duct 260 also serves to create a circular movement of air from the region of the ceiling toward the floor area, and that seeks to warm the latter. The same principle may be enlarged upon so that duct 260 also serves to pull down more highly-heated air that tends to collect toward the top of rooms with very high ceilings.

In FIG. 15, chimneys 270 and 271 are secured on the outside of firebox 204 adjacent to respective sides of opening 20. At its bottom end, chimney 270 is coupled into one end of manifold 62. Similarly, the bottom of chimney 271 is coupled into the other end of the manifold. Chimneys 270 and 271 serve to increase the draft of air through grate tubes 61 while the heating unit system is operating under a gravity-flow condition of air circulation. Chimneys 270 and 271 are installed in the space between firebox 204 and jacket 202. The upper ends of chimneys 270 and 271 are open so as to exhaust that air into the plenum area above firebox 204.

As also indicated in FIG. 15, a double-sided baffle 274 preferably is included interiorly intermediate the length of manifold 63. Baffle 274 serves to lessen turbulence of the air exiting from hollow grate tubes 61 and thereby to increase the gravity flow of air into the chimney.

With reference again to FIG. 3, an apertured plate 276 preferably spans the distance between upper wall 32 of the primary combustion area and upper wall portion 26. Plate 276 serves as a spark arrester, inhibiting the upward flowing of course sparks, such as from burning paper, and preventing them from escaping up the stack and onto the roof of the building. Such materials simply fall back into the primary combustion area.

Various modifications, of course, may be made at many different points in the structure. For example, the primary combustion area may be enlarged by extending rear wall 28 to a higher level and bringing the upper portion 32 of the rear wall more forwardly to form a throat. A series of tubes or chambers then may extent into the present plenum area so that the arrangement forms a dome or heat-chamber effect in the top of the unit, with the room air passing around those tubes or chambers. Such an arrangement should be even more efficient because of the trapping of heat from above the chimney outlet.

The system lends itself well to cooperation with an underground tempering system. As is well known, the temperature in the ground, below the frost line, remains rather constant, a representative value being around 59° F. In a manner analogous to that employed in other known heating systems, that ground temperature can be used to temper outside air, warming it in the winter and cooling it in the summer. Such an arrangement can be employed in conjunction with the aforedescribed outside air blower by cooling room air and adding just enough outside air for make-up.

Such a tempering system may be located beneath the aforementioned furnace room. The structure of a suitable tempering system need not be complicated nor expensive. A row of cement blocks may be used to form one or more multicelled air chambers. In one example, outside air is inletted through a duct to such a chamber. Air also is inletted through a duct from the interior space of the building under control by the unit. Another duct leads outwardly from the thus-formed air chamber and is connected to the outside air blower already discussed, such as blower 220.

When blower 220 is inoperative, make-up air enters through the outside air duct, travels through the interiors of the blocks, and is warmed. That warmed air then is conveyed by ductwork so as to enter through damper 218 of the system of FIG. 10. When a cooler make-up air supply is called for, blower 220 is energized and both room air through one duct and outside air is drawn through the tempering unit. In normal operation, such operation inhibits the build-up of frost in the intake of the tempering system. If necessary, however, an additional exhaust fan may be included for the supply of further ventilation by automatically letting more outside air into the tempering system.

The inclusion of a tempering system in the overall heating arrangement enables the user to increase the supply of fresh air during cold weather while reducing the amount of additional fuel needed to accommodate that fresh air. In the manner of known underground tempering systems, operation of only the circulation system in the summer, with the admission of outside air through the tempering unit, performs the function of air conditioning.

It will be observed that the various additions depicted and described afford, at the outset, a number of improvements to the basic heating system of the prior patent. Even though the approach of that patent has been successfully employed in a number of installations, significant advancement has been disclosed. In addition, a variety of specific improvements are of such a nature as to admit of utility in connection with still different heating systems.

In many cases, manufacture is facilitated by permitting reversibility of points of connection of different ductwork and other components. Moreover, the interconnection of adapting parts is such that essentially all operating portions of the system may be factory preassembled. All that is then required during field installation is the setting of the unit and the coupling thereto of conventionally-distributed ductwork.

Several aspects of the new disclosure contribute to increased safety. Moreover, automatic use of gravity-flow air circulation, when sufficient, has been afforded in a way which is safe even when the heating system is connected into a building ductwork system that also may be supplied with heat from a conventional furnace. Of course, the use of gravity flow when appropriate serves to reduce energy costs in operating blowers or fans.

While particular embodiments of the invention have been shown and described, and numerous modifications and alternatives have been suggested, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. For use in a heating system which includes a combustion chamber in which hot gases are delivered into a stack, a venting system closely adjacent to said chamber that comprises:

an inner tube communicating at its inlet end with said chamber for receipt of said gases;

an outer tube encircling said inner tube and coupleable into said stack at its outlet end;

a conduit opening laterally through the wall of said outer tube;

a weighted vane disposed in said conduit in the path of air inletted through the outer end of said conduit to constitute, with said conduit, a barometric damper;

sensing means responsive to the temperature in the vicinity of said tubes;

locking means for holding said vane in a closed position;

and means controlled by said sensing means for operating said locking means in correspondence with activity within said combustion chamber.

2. A venting control system as defined in claim 1 in which said controlled means effects closing of said damper automatically in response to the absence of significant combustion in said chamber.

3. A venting control system as defined in claim 1 in which said combustion chamber is fed with air from outside the space to which heat is supplied by said system, and which includes means for interrupting the supply of said air in response to reduction of said temperature below a pre-selected amount.

4. For use in a heating system which includes a combustion chamber from which hot gases are delivered into a stack, and which includes a barometric damper closely adjacent to said chamber for adjustably admitting additional air into said stack, the improvement comprising:

sensing means responsive to the temperature in the vicinity of said stack;

locking means for holding said damper in a closed position;

and means controlled by said sensing means for operating said locking means in correspondence with activity within said combustion chamber.

5. A venting control system as defined in claim 4 which includes means for supplying air to said chamber from outside the space being heated, and in which said locking means enables opening of said damper when said space requires heat.

6. For use in a heating system which includes a combustion chamber in which hot gases are delivered into a stack, a venting system closely adjacent to said chamber that comprises:

an inner tube communicating at its inlet end with said chamber for receipt of said gases;

an outer tube encircling said inner tube and coupleable into said stack at its outlet end;

a conduit opening laterally through the wall of said outer tube;

a weighted vane disposed in said conduit in the path of air inletted through the outer end of said conduit to constitute, with said conduit, a barometric damper;

and both said inner and said outer tubes being generally of an L-shape with one leg of each projecting toward said stack and the other leg of each being disposed generally horizontally, said conduit being generally horizontally disposed and opening into an intermediate portion of said outer tube.

7. A venting control system as defined in claim 6 in which said inner tube includes a selectively openable door facing said conduit and accessible therethrough.

8. For use in a heating system which includes a combustion chamber in which hot gases are delivered into a stack, a venting system located closely adjacent to said chamber that comprises:

an inner tube communicating at its inlet end with said chamber for receipt of said gases;

an outer tube encircling said inner tube and coupleable into said stack at its outlet end;

a conduit opening laterally through the wall of said outer tube;

a weighted vane disposed in said conduit in the path of air inletted through the outer end of said conduit to constitute with said conduit a barometric damper;

said inner tube extending upwardly above said conduit, disposing the outlet and the said inner tube at an elevation greater than the elvation of the upper most side of said conduit;

a combustion chamber defining a forwardly-facing opening through which fuel may be inserted;

a door assembly spaced forwardly of said chamber and having a door selectively closeable to substantially block the flow of air into said chamber from said space;

a closure assembly spaced between said door and said combustion chamber and selectively openable;

said closure assembly including a gate openable to permit insertion of said fuel through said door and into the primary burning portion of said chamber;

and said gate being hingedly mounted to swing down and forward when opened and includes an andiron structure that projects upwardly, when said gate is opened, to assist loading of solid fuel into said chamber.

9. For use in a heating system which includes a combustion chamber in which to gases are delivered into a stack, a venting system located closely adjacent to said chamber that comprises:

an inner tube communicating at its inlet end with said chamber for receipt of said gases;

an outer tube encircling said inner tube and coupleable into said stack at its oulet end;

a conduit opening laterally through the wall of said outer tube;

a weighted vane disposed in said conduit in the path of air inletted through the outer end of said conduit to constitute with said conduit a barometric damper;

said inner tube extending upwardly above said conduit, disposing the outlet and the said inner tube at an elevation greater than the elevation of the upper most side of said conduit;

a combustion chamber defining a forwardly-facing opening through which fuel may be inserted;

a door assembly spaced forwardly of said chamber and having a door selectively closable to substantially block the flow of air into said chamber from said space;

a closure assembly spaced between said door and said combustion chamber and selectively openable;

said closure assembly including a gate openable to permit insertion of said fuel through said door and into the primary burning portion of said chamber;

and in which said combustion chamber includes a rigid shell within the side walls of which firewall plates are disposed in an inwardly spaced position, said plates extending towards said gate, when the latter is closed, to divert leakage air movement through said door assembly away from said primary burning portion.

10. For use in a heating system which includes a combustion chamber in which hot gases are delivered into a stack, a venting system closely adjacent to said chamber that comprises:

an inner tube communicating at its inlet end with said chamber for receipt of said gases;

an outer tube encircling said inner tube and coupleable into said stack at its outlet end;

a conduit opening laterally through the wall of said outer tube;

a weighted vane disposed in said conduit in the path of air inletted through the outer end of said conduit, to constitute, with said conduit, a barometric damper;

said inner tube extending upwardly above said conduit, disposed the outlet end of said inner tube at an elevation greater than the elevation of the uppermost side of said chamber;

a grate composed of plurality of laterally-spaced tubes on which solid fuel is combusted and within which air to be heated is circulated, and a manifold commonly connecting the forward ends of said tubes;

a plurality of bars joined into an assembly which seats individually different ones of said bars respectively between corresponding ones of said tubes;

said bars being conformed at their forward end portions to seat above said manifold;

and a shield closing the spaces between said forward end portions and positioned to block the flow of combustion air into said manifold.

11. In a heating system as defined in claim 10 in which said shield further includes means disposed in the path of combustion air for inhibiting the passage thereof toward the rear of said grate.

12. A heating system as defined in claim 1 which further includes:

a combustion chamber defined in part by a rigid wall;

a grate composed of a plurality of laterally-spaced tubes on which solid fuel is combusted and within which air to be heated is circulated;

and a connection assembly comprising:

a pair of facing U-shaped clamps sized to grip an end portion of one of said tubes;

a first pair of elements defined in one of said clamps individually in respective legs to face another of said clamps;

a second pair of elements effectively defined in said other clamp to mate with said first pair of elements;

a fastener engageable between each of the mating ones of said elements for securing said clamps about said end portion;

a retainer disposed on the side of said wall opposite said one clamp;

and means for securing said one clamp through said wall to said retainer.

13. An assembly as defined in claim 12 in which said securing means further includes:

at least one additional element effectively defined in one of said clamps for enabling securement in a direction aligned with said one tube;

and another fastener projecting through said wall between said one clamp and said retainer.

14. In a heating system which includes:

a combustion chamber in which fuel is burned to produce heat for an interior space;

means for supplying combustion air to said chamber from outside said space;

and means for circulating air in heat exchange with said combustion chamber but exclusive of said combustion air for delivering heat to said space;

the improvement comprising:

said circulating means including a plenum chamber into which heat produced within said combustion chamber is delivered;

an intake of air from outside said space and leading into said plenum chamber;

means for propelling air from said intake toward said plenum chamber;

a first damper, disposed between said intake and said plenum chamber, normally closed to prevent a backflow of warmed air to said outside but automatically admitting said outside air into said plenum chamber upon operation of said propelling means;

and in which a blower is located in said intake stream from said first damper for moving outside air towards said plenum chamber, and which further includes a normally-open second damper disposed upstream from said blower and automatically closable upon activation of said blower.

15. In a heating system which includes:

a combustion chamber in which fuel is burned to produce heat for an interior space;

means for supplying combustion air to said chamber from outside said space;

and means for circulating air in the heat exchange with said combustion chamber but exclusive of said combustion air for delivering heat to said space;

the improvement comprising;

said circulating means including a plenum chamber into which heat produced within said combustion chamber is delivered;

an intake of air from outside said space and leading into said plenum chamber;

means for propelling air from said intake toward said plenum chamber;

a first damper, disposed between said intake and said plenum chamber, normally closed to prevent a backflow of warmed air to said outside but automatically admitting said outside air into said plenum chamber upon operation of said impelling means;

a vent opening into said space from said plenum chamber and a fan for moving air in said circulating system, and which includes a third normally-opened damper in said vent but automatically closed in response to operation of said fan.

16. In a heating system which includes:

a combustion chamber in which fuel is burned to produce heat for an interior space;

means for supplying combustion air to said chamber from outside said space;

and means for circulating air in heat exchange with said combustion chamber but exclusive of said combustion air for delivering heat to said space;

the improvement comprising:

said circulating means including a plenum chamber into which heat produced within said combustion chamber is delivered;

a duct leading form said plenum chamber and outletting into said space;

a fan for moving air in said circulation system; and a normally-closed damper disposed between said plenum chamber and said duct, said damper opening automatically in response to operation of said fan.

17. In a heating system which includes:

a combustion chamber in which fuel is burned to produce heat for an interior space;

means for supplying combustion air to said chamber from outside said space;

and means for circulating air in heat exchange with said combustion chamber but exclusive of said combustion air for delivering heat to said space;

the improvement comprising:

said circulating means including a plenum chamber into which heat produced within said combustion chamber is delivered;

a duct leading from said plenum chamber and outletting into said space;

a fan for moving air in said circulation system;

a normally-closed damper disposed between said plenum chamber and said duct, said damper opening automatically in response to operation of said fan; and a blower for feeding said outside air into said plenum chamber, and which also includes a sensor, disposed downstream from said damper, together with means for activating said blower when said sensor detects a temperature value which exceeds a predetermined limit.

18. In a heating system which includes:

a combustion chamber in which fuel is burned to produce heat for an interior space;

means for supplying combustion air to said chamber from outside said space;

and means for circulating air in heat exchange with said combustion chamber but exclusive of said combustion air for dlivering heat to said space;

the improvement comprising:

said circulating means including a plenum chamber into which heat produced within said combustion chamber is delivered;

a duct leading from said space into said circulation system;

a fan for moving air in said circulation means;

and a normally-open damper between said duct and said circulation means, said damper automatically closing in response to operation of said fan.

19. For use in a heating system which includes a combustion chamber is which hot gases are delivered into a stack, a venting system closely adjacent to said chamber that comprises;

an inner tube communicating at its inlet and with said chamber for receipt of said gases;

an outer tube encircling said inner tube and coupleable into said stack at its outlet end;

a conduit opening laterally through the wall of said outer tube;

a weight vane disposed in said conduit in the path of air inletted through the outer end of said conduit to constitute, with said conduit, a barometric damper;

said inner tube extending upwardly above said conduit, disposing the outlet end of said inner tube at an elevation greater than the elevation of the uppermost side of said conduit;

a combustion chamber defining a forwardly-facing opening through which fuel may be inserted;

a door assembly spaced forwardly of said chamber and having a door selectively closeable to substantially block the flow of air into said chamber from said space;

a plenum chamber disposed above said combustion chamber;

and a shield spaced forwardly from said combustion chamber and defining a space communicating air flow between said door assembly and said plenum chamber and downwardly into the area framing said door assembly.

20. In a heating system which includes:

a combustion chamber in which fuel is burned to produce heat for an interior space;

means for supplying combustion air to said chamber from outside said space;

and means for circulating air in heat exchange with said combustion chamber but exclusive of said combustion air for delivering heat to said space;

the improvement comprising:

said circulating means including a plenum chamber into which heat produced within said combustion chamber is delivered;

a discharge opening in said plenum chamber that communicates with said space;

and a duct leading from a portion of said plenum chamber, disposed above said discharge opening, to an entrance located in the vicinity of the bottom of said combustion chamber and opening into said space.

* * * * *